United States Patent [19]

Hurt

[11] Patent Number: 4,487,274

[45] Date of Patent: Dec. 11, 1984

[54] ROCK DRILLS

[75] Inventor: John A. Hurt, Brookside, England

[73] Assignee: Weaver & Hurt Limited, England

[21] Appl. No.: 400,233

[22] Filed: Jul. 21, 1982

[51] Int. Cl.[3] ..... E21C 3/24

[52] U.S. Cl. ..... 173/134; 173/116

[58] Field of Search ..... 173/134, 135, 136, 137, 173/138, 73, 17, 116; 408/17; 175/296, 297, 298; 91/232, 236

[56] References Cited

U.S. PATENT DOCUMENTS

| | | | |
|---|---|---|---|
| 2,837,317 | 6/1958 | Hulshizer | 173/17 |
| 2,922,626 | 1/1960 | Sutliff | 175/297 |
| 2,937,619 | 5/1960 | Kurt | 173/17 |
| 3,164,214 | 1/1965 | Oelke | 173/136 |
| 3,991,835 | 11/1976 | Bailey et al. | 173/134 |
| 4,133,393 | 1/1979 | Richards | 173/73 |
| 4,312,412 | 1/1982 | Pillow | 173/73 |

*Primary Examiner*—Frank T. Yost

*Assistant Examiner*—Hien H. Phan

*Attorney, Agent, or Firm*—King and Liles

[57] ABSTRACT

A rock drill is provided including a flap valve allowing high cutting speed operation over a range of compressed air pressures. The rock drill further includes a wear sleeve secured to a back head with a chuck to the opposite side, an inner cylinder within the wear sleeve, a valve seat at the inner end of the cylinder with a valve stem extending into the cylinder, and a piston within the cylinder reciprocable from one position where the valve stem engages a bore in the piston to a position where the stem enters a bearing in the cylinder to strike a drill bit held by the chuck. The ratio of the piston head area to its bore area is 9.9/9.95 to 1. The ratio of the piston head length to the stem length is 1.5/1.52 to 1. The ratio of piston head diameter to stem diameter is 1.4/1.43 to 1 and the ratio of piston stem length to the length of stem within the bearing at the point at which the piston strikes the bit is 1.4/1.45 to 1.

3 Claims, 2 Drawing Figures

ROCK DRILLS

Figures 1, 1A:
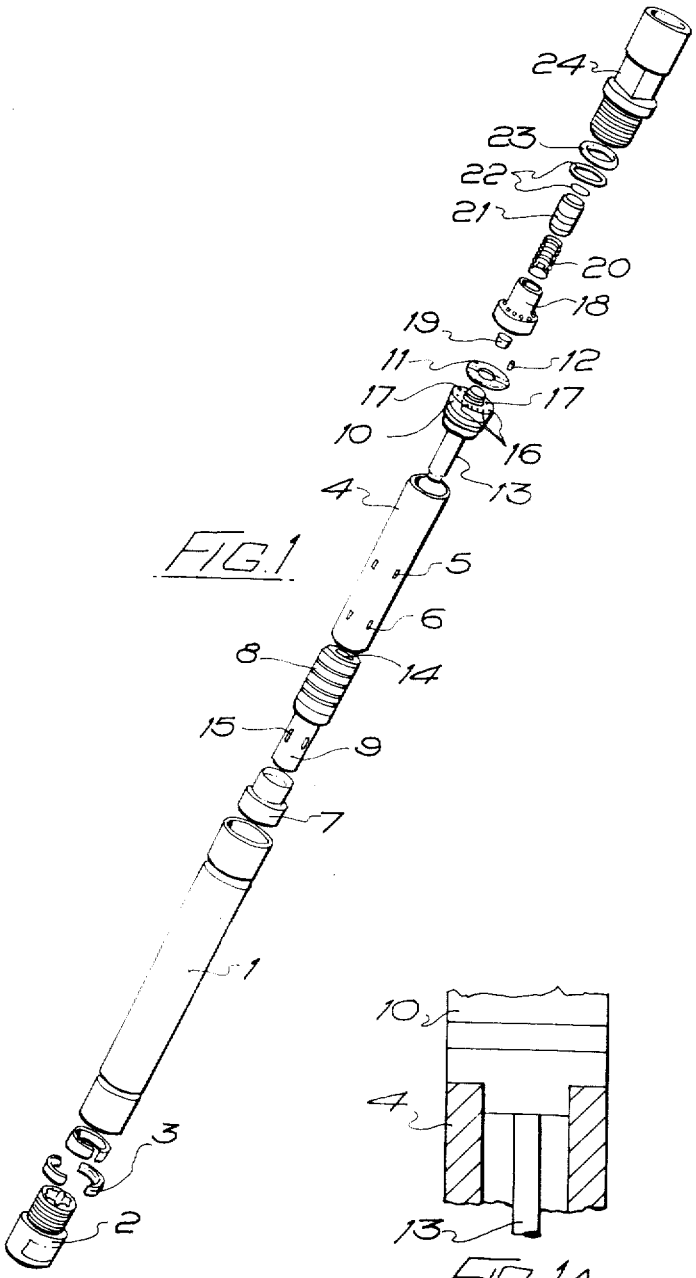

This invention relates to rock drilling equipment and is particularly concerned with rock drills of the down-the-hole type where the drill is secured to a first tube down which compressed air is passed to activate the drill, as many tubes as are required being successfully secured to a preceding tube to allow a hole to be drilled to the depth required.

Still more particularly, the present invention relates to the type of drill incorporating a flap valve to allow the application of compressed air to one side or the other of a piston which can thus be reciprocated within its cylinder to repeatedly strike the end of a drill bit secured to the drill.

Hitherto such drills have been designed to operate at a particular air pressure and accordingly there are currently available drills intended for operation with either a low pressure or a high pressure air supply. This has the disadvantage that if on a particular site the compressed air availability does not suit the particular drill, then the effectiveness of the drill is considerably reduced.

It is therefore one objective of the present invention to provide a drill of the type defined capable of being successfully operated over a wide range of air pressures.

Rock drilling is by its very nature a particularly expensive exercise because of the need to employ such cost capital plant, and obviously the more rapidly can a hole be drilled the less expensive does rock drilling become on a cost per hole basis. Considerable attention has been given to increasing the speed at which a hole of a required diameter can be cut and despite the extensive attention that this problem has been given over a considerable number of years, drilling speeds, for practical purposes, have not been increased to any noticeable extent.

It is therefore a second object of the present invention to provide a drill capable of cutting holes at a considerably greater rate than has been possible hitherto.

According to the present invention an air operated down-the hole drill comprises a backhead for the connection of a drill to a source of compressed air, a wear sleeve secured to the backhead and a chuck adapted to retain a drill bit secured to the opposite end of the wear sleeve, there being within the wear sleeve an inner cylinder with a valve seat at one (inner) end of the cylinder having a portion of reduced diameter to fit within the cylinder and a valve stem extending into the cylinder and a piston within the cylinder reciprocable therein from one position where the valve stem engages in a bore in the piston to a second position where a stem on the piston enters a bearing located in the cylinder and strikes a drill bit held within the chuck, the dimensions of the piston being such that the ratio of the piston head area to its bore area is in the range 9.9/9.95 to 1, the ratio of the piston head length to the piston stem length is in the range 1.5/1.52 to 1, the ratio of the piston head diameter to the piston stem diameter is in the range 1.4./1.43 to 1 and the ratio of the piston stem length to the length of the piston stem within the bearing at the point at which the piston strikes the drill bit is 1.4/1.45 to 1.

The weight of piston is obviously dictated by its size but the piston weight is believed to be equally critical. Thus, for example, with a 3" rock drill the piston weight should be in the range 5 lb. 8 oz to 5 lb. 9 oz.

According to a further feature of the invention a rock drill of the type defined comprises a valve seat wherein the ratio of the cross-sectional area of the portion of the valve seat that fits within the cylinder to the cross-sectional area of the stem of the valve seat is in the range 10.0/11.0 to 1, the ratio of the stroke length of the piston to the length of the stem of the valve seat is 0.87/0.88 to 1 and the ratio of the net internal length of the bearing to the stroke length of the piston is in the range 0.56/0.57 to 1.

It has been found that with a down-the-hole drill constructed as defined above the drill has been successfully and unpredictably useable over a wide range of air pressures from as low of 6 to 7 bar to as high as 17 bar. Not only that, the cutting speeds of such drills in comparison with comparable drills known hitherto have shown a dramatic and unforseeable increase in cutting speed which during independent testing was from 30% to 60% faster than conventional drills. To exemplify this the following are three examples of comparative test hole drilling where, as is usual, two drills were run simultaneously as close together as practical conditions would allow so that each drill was running through substantially identical substrate.

EXAMPLE 1

In a test drilling through granite having a crushing strength of 50,000 lbs p.s.i. using a compressed air pressure of 250 lbs p.s.i. a drill bit in accordance with the invention and carrying a 90 mm bit was compared with a conventional drill of U.S. origin carrying a 104 mm bit. In the test nine successive six foot lengths of tube were coupled on to each drill to drill a hole 54 feet deep, and the time taken by each drill to cut the final 30 feet taken. This experiment was conducted by the quarry operatives. The drill of the invention was found to cut the final 30 feet of hole in 35 minutes whereas the drill of the prior art was found to take 53.6 minutes, a breakdown of time per tube being given below:

| Tube No. | The drill of the invention | The drill of the prior art |
|---|---|---|
| 5 | 8.8 | 12.0 |
| 6 | 6.5 | 12.0 |
| 7 | 6.1 | 6.30 |
| 8 | 7.3 | 10.00 |
| 9 | 6.3 | 13.30 |
| | 35.0 | 53.60 |

This showed the drill of the invention to be running 53.1% faster than the conventional drill.

EXAMPLE 2

In a test drilling through rock limestone having a crushing strength of 20,000 lbs p.s.i. to 34,000 lbs p.s.i. using a compressed air pressure of 170 lbs p.s.i. a drill in accordance with the invention and carrying a 90 mm bit was compared with a second conventional drill also of U.S. origin also carrying a 90 mm bit. In tests six successive tubes of the lengths detailed below were coupled on to each drill to drill a hole 53 foot deep and the time taken to drill the full length of the hole. This experiment was conducted by the quarry operatives. The drill of the invention was found to cut the hole in 41.5 minutes whereas the drill of the prior art was found to take 56.8 minutes. A breakdown of time per tube being given below:

| Tube No. | Length | The Drill of the invention | The Drill of the prior art |
|---|---|---|---|
| 1 | 11 ft. | 8.8 | 11.8 |
| 2 | 10 ft. | 8.0 | 11 |
| 3 | 10 ft. | 8.2 | 11.2 |
| 4 | 10 ft. | 8.0 | 11 |
| 5 | 10 ft. | 7.2 | 10.2 |
| 6 | 2 | 1.3 | 1.6 |
| | 53 | 41.5 | 56.8 |

This showed the drill of the invention to be running 36.86% faster than the conventional drill.

EXAMPLE 3

In a test drilling through talc in a matrix of hard abrasive granite having a crushing strength of 50,000 lbs p.s.i. using a compressed air pressure of 85 lbs p.s.i. a drill bit in accordance with the invention and carrying a 90 mm bit was compared with a conventional drill of German origin carrying a 3.25" button bit. In the test each drill was used to cut a hole of 5 meter depth with the successive application of standard tube lengths to each drill. This experiment was conducted by the quarry operatives, and the time for each drill to cut the hole to the required depth taken. With the drill of the invention the time was 42.8 minutes and with the drill of the prior art the time was 68.5 minutes. This showed the drill of the invention to be running 60.04% faster than the conventional drill.

One embodiment of the invention is illustrated in the accompanying drawing in which FIG. 1 is an exploded perspective view of a drill in accordance with the invention and FIG. 1A is an enlarged cross-sectional view showing the valve seat connected to the cylinder.

In the drawing a rock drill comprises a wear sleeve 1 at one (bottom) end of which is provided a chuck 2 to receive a drill bit (not shown), the drill bit being held by a retaining ring 3. Within the wear sleeve is a cylinder 4 having upper and lower ports 5, 6 the outer diameter of the cylinder and the inner diameter of the wear sleeve 1 being such that an annular gap is provided between them. At the bottom end of the cylinder there is provided an integral bearing 7 and within the cylinder is a piston 8, the piston having a stem 9 which engages in and is a close sliding fit with the bearing. At the opposite end of the cylinder there is provided an integral valve seat 10 on which rests a flap valve 11 held in place by a pin 12, the integral seat 10 having a stem 13 which extends into the cylinder to be engaged by the bore 14 of the piston 8 which bore extends to ports 15 emerging in the piston stem 9. Through the valve seat 10 are two sets of passageways 16, 17 for selective closing by the flap valve 11, the passageways 16 extending directly through the valve seat to emerge in the cylinder alongside the stem 13, and the passageways 17 emerging at the side wall of the integral seat. Above the flap valve is a valve chest 18 having a through bore partially closed by an air metering plug 19 the valve chest being held in place by a spring 20 on which rests a check valve 21, the whole assembly being held in place with sealing rings 22 and a spacer 23 by a backhead 24 secured to the (top) end of the wear sleeve.

At rest and in the absence of pressure air, and with the rock drill lifted clear of the ground, a drill bit secured in the chuck 2 slides downwardly until its inner end contacts the bit retaining ring. In this condition the piston is at rest with the shoulder between the piston 8 and its stem 9 resting on the bearing 7, and the flap valve 11 is in a neutral position.

On the application of compressed air, air passes through the backhead 24 and passed the check valve 21, through the valve chest 18 and around both sides of the flap valve such that part of the air passes through the passageways 16 and into the inner cylinder, the remaining air passing through the passageways 17 to pressurise the annulus between the inner cylinder 4 and the wear sleeve 1, the ports 6 in the inner cylinder in this condition being closed at the inner side by the piston head 8. The drill is then lowered until the bit contacts the ground thus pushing the bit rearwardly with respect to the chuck until it contacts the piston stem and lifts the piston to open the ports 6 to provide air below the piston for the up stroke. Further relative movement causes the piston stem 9 to clear the integral bearing 7 when air passes down through the bearing 7 to emerge around the bit. The sudden drop in pressure below one side of the flap valve causes the flap valve to tilt to close the passageways 17 such that all the incoming air then passes through the passageways 16 and into the cylinder as the piston, on its up stroke, is approaching top dead centre. The bore 14 in the piston then engages the stem 13 on the valve seat. The continued upward movement of the piston to top dead centre and the incoming air through the passageways 16 producing a pressure above the cylinder to generate the down stroke. During the down stroke and as the piston head clears the valve seat stem 13, the air above the piston chases down through the piston bore causing a pressure drop and a tilting of the flap valve 11 to close the passageways 16, open the passageways 17 thereby causing pressure air to pass down the annulus between the cylinder 4 and the wear sleeve 1 to enter the cylinder through the ports 6 to load the cylinder below the piston. As the piston approaches bottom dead centre the pressure air has a cushioning effect not sufficient to prevent the piston from reaching bottom dead centre and striking by its stem 9 the drill bit in the chuck 2. After it has struck the drill bit, it rebounds and the pressure below the piston generates the up stroke and when the cycle is repeated for so long as pressure air is maintained.

By constructing the piston and the integral valve seat in accordance with the invention such a rock drill as has been demonstrated earlier in respect of the Examples operates at speeds which could not have been predicted and these totally unexpected speeds result in a rock drill that operates with considerably greater cost efficiency than has been possible hitherto, and more than that is capable of operation over a range of air pressures which again has not been possible hitherto.

I claim:

1. An air operated down-the-hole drill comprising a backhead for the connection of a drill to a source of compressed air, a wear sleeve secured to the backhead and a chuck adapted to retain a drill bit secured to the opposite end of the wear sleeve, there being within the wear sleeve an inner cylinder with a valve seat at one (inner) end of the cylinder having a valve stem extending into the cylinder and a piston within the cylinder reciprocable therein from one position where the valve stem engages in a bore in the piston to a second position where a stem on the piston enters a bearing located in the cylinder and strikes a drill bit held within the chuck, the dimensions of the piston being such that the ratio of the piston head area to its bore area is in the range 9.9/9.95 to 1, the ratio of the piston head length to the piston stem length is in the range 1.5/1.52 to 1, the ratio of the piston head diameter to the piston stem diameter is in the range 1.4/1.43 to 1 and the ratio of the piston stem length to the length of the piston stem within the bearing at the point at which the piston strikes the drill bit is 1.4/1.45 to 1.

2. An air operated down-the-hole drill as in claim 1, wherein for a 3" rock drill the piston weight is in the range 5 lb. 8 oz to 5 lb. 9 oz.

3. An air operated down-the-hole drill comprising a cylinder, a piston and a valve seat having a stem wherein the ratio of the cross-sectional area of a part of the valve seat within the cylinder to the cross-sectional area of the stem of the valve seat is in the range 10.0/11.0 to 1, the ratio of the stroke length of the piston to the length of the stem of the valve seat is 0.87/0.88 to 1 and the ratio of the net internal length of the bearing to the stroke length of the piston is in the range 0.56/0.57 to 1.

* * * * *